US011892255B1

(12) United States Patent
Huang

(10) Patent No.: US 11,892,255 B1
(45) Date of Patent: Feb. 6, 2024

(54) INTERCHANGEABLE ELEMENT ATTACHMENT SYSTEM

(71) Applicant: Battlearms IP, LLC, Henderson, NV (US)

(72) Inventor: George Huang, Henderson, NV (US)

(73) Assignee: Battlearms IP, LLC, Henderson, NV (US)

( * ) Notice: Subject to any disclaimer, the term of this patent is extended or adjusted under 35 U.S.C. 154(b) by 0 days.

(21) Appl. No.: 17/985,706

(22) Filed: Nov. 11, 2022

(51) Int. Cl.
*F41A 17/36* (2006.01)
*F41A 3/72* (2006.01)
*F41A 35/06* (2006.01)

(52) U.S. Cl.
CPC ..... *F41A 17/36* (2013.01); *F41A 3/72* (2013.01); *F41A 35/06* (2013.01)

(58) Field of Classification Search
CPC ..... F41A 17/36; F41A 35/06; F41A 17/42
USPC ..... 89/138
See application file for complete search history.

(56) References Cited

U.S. PATENT DOCUMENTS 8,161,861 B2 * 4/2012 Haley ..... F41A 35/06 89/1.4
8,692,477 B1 * 4/2014 Lee ..... H05B 45/38 315/307
9,291,412 B1 * 3/2016 Montes ..... F41A 17/36
10,775,120 B2 * 9/2020 Harris ..... F41A 17/42
11,530,886 B2 * 12/2022 Bray ..... F41A 3/68
2011/0283580 A1 * 11/2011 Esch ..... F41A 17/42 403/362

OTHER PUBLICATIONS https://magpul.com/bad-lever-battery-assist-device-ar15-m4.html?mp_global_color=118.

* cited by examiner

*Primary Examiner* — Reginald S Tillman, Jr.
(74) *Attorney, Agent, or Firm* — Shaddock Law Group, PC

(57) ABSTRACT

An interchangeable element attachment system, including at least some of a bolt catch, wherein an attachment aperture is formed through a portion of an upper button portion of the bolt catch; an assist lever, wherein one or more attachment aperture engaging projections extend from a portion of an assist lever second side, within an attachment portion of the assist lever, wherein a portion of the attachment aperture engaging projection is received within at least a portion of the attachment aperture of the bolt catch, such that one or more portions of the attachment aperture engaging projection are abutted against one or more corresponding portions of the attachment aperture, and wherein an at least partially internally threaded fastener recess extends within the attachment portion; and a fastener positionable through the aligned attachment aperture and fastener recess to assist in attaching or coupling the assist lever to the bolt catch.

17 Claims, 16 Drawing Sheets

INTERCHANGEABLE ELEMENT ATTACHMENT SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms and is particularly directed to improved systems and methods for attaching or coupling interchangeable components.

2. Description of Related Art

It is well known that various firearms, such as, for example, the AR-15 or M-4 style firearms, are provided with a bolt catch that is typically pivotably attached or coupled to the lower receiver on a left side, opposite the magazine release button. The bolt catch includes an upper button portion and a lower button portion, each of which can be pressed to pivot the bolt catch about a pivot pin aperture to pivot the bolt catch from a bolt engagement position to a bolt disengagement position. The bolt catch is typically spring biased to the bolt disengagement position.

In the bolt engagement position, the bolt catch is pivoted such that at least a portion of a bolt engagement projection extends in front of the face of the bolt carrier (when the bolt carrier is in a rearward position) and engages the bolt face to maintain the ball carrier in the rearward position.

A magazine biasing projection extends from the bolt catch so as to interact with a follower in a magazine. In this manner, when an empty magazine is in the firearm, the magazine follower interacts with the magazine biasing projection, to pivot the bolt catch to a bolt engagement position.

When the upper button portion is depressed, the bolt catch pivots such that the bolt engagement projection is urged downward, away from the face of the bolt carrier, allowing the bolt carrier to move forward.

However, it can be difficult to manipulate the bolt catch from the right side of the firearm. Various assist levers have been created that can be attached or coupled to the bolt catch, which allow certain manipulations of the bolt catch from the right side of the firearm.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY AND OBJECTS OF THE DISCLOSURE

Unfortunately, known systems and methods for attaching or coupling known assist levers to known bolt catches involve merely sandwiching a portion of the bolt catch between opposing elements of the assist lever. This provides an unreliable, problematic attachment that allows for twisting, wiggling, or rotational movement of the assist lever relative to the bolt catch.

These disadvantages of the prior art are overcome with the present disclosure and interchangeable element attachment system, which provides a secure, reliable attachment or connection between interchangeable elements, such as, for example, in assist lever and a bolt catch.

In various exemplary, non-limiting embodiments, the present disclosure comprises an interchangeable element attachment system having a bolt catch having an upper button portion defined by an outer perimeter surface and a lower button portion, wherein a pivot pin aperture is formed through the bolt catch between the upper button portion and the lower button portion, wherein at least one attachment aperture is formed through a portion of the upper button portion, and wherein the attachment aperture is defined by one or more attachment aperture sidewalls; an assist lever having an attachment portion, a connector portion, and an extension arm extending to an assist lever button portion, wherein one or more attachment aperture engaging projections extend from a portion of an assist lever second side of the assist lever, within a portion of the attachment portion, wherein each attachment aperture engaging projection is defined by one or more attachment aperture engaging projection sidewalls, wherein one or more perimeter engaging projections extend from a portion of the assist lever second side of the assist lever, within a portion of the attachment portion, wherein each perimeter engaging projection is defined by one or more perimeter engaging projection sidewalls, wherein at least a portion of the attachment aperture engaging projection is received within at least a portion of the attachment aperture of the bolt catch, such that one or more portions of the attachment aperture engaging projection sidewalls are abutted against one or more corresponding portions of the attachment aperture sidewalls, wherein at least a portion of each perimeter engaging projection is abutted against at least a portion of the outer perimeter surface of the bolt catch, such that one or more portions of the perimeter engaging projection sidewalls may be abutted against one or more corresponding portions of the outer perimeter surface, and wherein at least one at least partially internally threaded fastener recess extends from the assist lever second side, within the attachment portion; and at least one fastener, wherein the fastener is at least partially externally threaded, wherein the internal threading of the fastener recess allows interaction between the internal threads of the fastener recess and the external threads of the fastener, and wherein if the assist lever is appropriately aligned with the bolt catch and the fastener recess is appropriately centered relative to the attachment aperture, the fastener is positionable through the aligned attachment aperture and fastener recess to engage a portion of an upper button portion second side to assist in attaching or coupling the assist lever to the bolt catch.

In certain exemplary embodiments, a portion of the upper button portion includes a textured portion.

In certain exemplary embodiments, the bolt catch is pivotally connected to a lower receiver via a bolt catch pivot pin positioned through a portion of the lower receiver and the pivot pin aperture.

In certain exemplary embodiments, the attachment aperture is defined by one or more contiguous attachment aperture sidewalls.

In certain exemplary embodiments, the attachment aperture is formed through the bolt catch from an upper button portion first side through an upper button portion second side.

In certain exemplary embodiments, the attachment aperture is a substantially triangular shaped aperture and a portion of the attachment aperture engaging projection is a substantially triangular shaped projection.

In certain exemplary embodiments, the connector portion extends between the attachment portion and the extension arm.

In certain exemplary embodiments, the assist lever is formed such that if the bolt catch is attached or coupled to a lower receiver and the assist lever is attached or coupled to the bolt catch, at least a portion of the extension arm extends through a trigger guard portion of the lower receiver.

In certain exemplary embodiments, at least a portion of the attachment aperture engaging projection is defined by an exterior shape that matingly corresponds to a portion of an interior shape of the attachment aperture of the bolt catch.

In certain exemplary embodiments, at least a portion of each perimeter engaging projection is defined by an exterior shape that matingly corresponds to a portion of the exterior shape of the outer perimeter surface of the bolt catch.

In certain exemplary embodiments, the fastener is a flange tapered screw.

In other exemplary, non-limiting embodiments, the present disclosure comprises an interchangeable element attachment system having a bolt catch having an upper button portion defined by an outer perimeter surface, wherein at least one attachment aperture is formed through a portion of the upper button portion, and wherein the attachment aperture is defined by one or more attachment aperture sidewalls; an assist lever having an attachment portion, wherein one or more attachment aperture engaging projections extend from a portion of an assist lever second side of the assist lever, within a portion of the attachment portion, wherein each attachment aperture engaging projection is defined by one or more attachment aperture engaging projection sidewalls, wherein at least a portion of the attachment aperture engaging projection is received within at least a portion of the attachment aperture of the bolt catch, such that one or more portions of the attachment aperture engaging projection sidewalls are abutted against one or more corresponding portions of the attachment aperture sidewalls, and wherein at least one at least partially internally threaded fastener recess extends from the assist lever second side, within the attachment portion; and at least one fastener, wherein if the assist lever is appropriately aligned with the bolt catch and the fastener recess is appropriately centered relative to the attachment aperture, the fastener is positionable through the aligned attachment aperture and fastener recess to threadedly engage a portion of an upper button portion second side to assist in attaching or coupling the assist lever to the bolt catch.

In certain exemplary embodiments, one or more perimeter engaging projections extend from a portion of the assist lever second side of the assist lever, within a portion of the attachment portion, and wherein each perimeter engaging projection is defined by one or more perimeter engaging projection sidewalls.

In certain exemplary embodiments, at least a portion of each perimeter engaging projection is abutted against at least a portion of the outer perimeter surface of the bolt catch, such that one or more portions of the perimeter engaging projection sidewalls may be abutted against one or more corresponding portions of the outer perimeter surface.

In certain exemplary embodiments, the assist lever is formed such that if the bolt catch is attached or coupled to a lower receiver and the assist lever is attached or coupled to the bolt catch, at least a portion of the assist lever extends through a trigger guard portion of the lower receiver.

In certain exemplary embodiments, at least a portion of the attachment aperture engaging projection is defined by an exterior shape that matingly corresponds to a portion of an interior shape of the attachment aperture of the bolt catch.

In certain exemplary embodiments, at least a portion of each perimeter engaging projection is defined by an exterior shape that matingly corresponds to a portion of the exterior shape of the outer perimeter surface of the bolt catch.

In certain exemplary, non-limiting embodiments, the present disclosure comprises an interchangeable element attachment system having a bolt catch having an upper button portion defined by an outer perimeter surface, wherein a pivot pin aperture is formed through the bolt catch, wherein at least one attachment aperture is formed through a portion of the upper button portion, and wherein the attachment aperture is defined by one or more attachment aperture sidewalls; an assist lever having an attachment portion, wherein one or more perimeter engaging projections extend from a portion of the assist lever second side of the assist lever, within a portion of the attachment portion, wherein each perimeter engaging projection is defined by one or more perimeter engaging projection sidewalls, wherein at least a portion of each perimeter engaging projection is abutted against at least a portion of the outer perimeter surface of the bolt catch, such that one or more portions of the perimeter engaging projection sidewalls may be abutted against one or more corresponding portions of the outer perimeter surface, and wherein at least one at least partially internally threaded fastener recess extends from the assist lever second side, within the attachment portion; and at least one fastener, wherein the at least one fastener is at least partially externally threaded, wherein the internal threading of the at least one fastener recess allows interaction between the internal threads of the at least one fastener recess and the external threads of the at least one fastener, and wherein if the assist lever is appropriately aligned with the bolt catch and the at least one fastener recess is appropriately centered relative to the attachment aperture, the at least one fastener is positionable through the aligned attachment aperture and fastener recess to engage a portion of an upper button portion second side to assist in attaching or coupling the assist lever to the bolt catch.

In still other exemplary, non-limiting embodiments, the present disclosure comprises an interchangeable element attachment system having an attachment base having an upper button portion defined by an outer perimeter surface, wherein at least one attachment aperture is formed through a portion of the upper button portion; an attachment element having an attachment portion, wherein one or more attachment aperture engaging projections extend from a portion of a second side of the attachment element, within a portion of the attachment portion, wherein at least a portion of the attachment aperture engaging projection is received within at least a portion of the attachment aperture of the attachment base, such that one or more portions of the attachment aperture engaging projection are abutted against one or more corresponding portions of the attachment aperture, and wherein at least one at least partially internally threaded fastener recess extends from the second side of the attachment element, within the attachment portion; and at least one fastener, wherein if the attachment element is appropriately aligned with the attachment base and the fastener recess is appropriately centered relative to the attachment aperture, the fastener is positionable through the aligned attachment aperture and fastener recess to threadedly engage a portion of an upper button portion second side to assist in attaching or coupling the attachment element to the attachment base.

In certain exemplary embodiments, one or more perimeter engaging projections extend from a portion of the second side of the attachment element, within a portion of the attachment portion.

In certain exemplary embodiments, at least a portion of each perimeter engaging projection is abutted against at least a portion of the outer perimeter surface of the attachment base, such that one or more portions of the perimeter engaging projection may be abutted against one or more corresponding portions of the outer perimeter surface.

Accordingly, the presently disclosed systems, methods, and/or apparatuses separately and optionally provide an improved attachment system for various elements or components.

The presently disclosed systems, methods, and/or apparatuses separately and optionally provide improved and attachment system for interchangeable elements or components.

The presently disclosed systems, methods, and/or apparatuses separately and optionally provide an improved attachment or coupling system that allows attachment elements to be quickly and easily interchangeable relative to an attachment base.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments discussed herein. In similar fashion, while exemplary embodiments may be discussed below as device, system, or method embodiments, it is to be understood that such exemplary embodiments can be implemented in various devices, systems, and methods of the present disclosure.

BRIEF DESCRIPTION OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE DISCLOSURE

Figure 1:
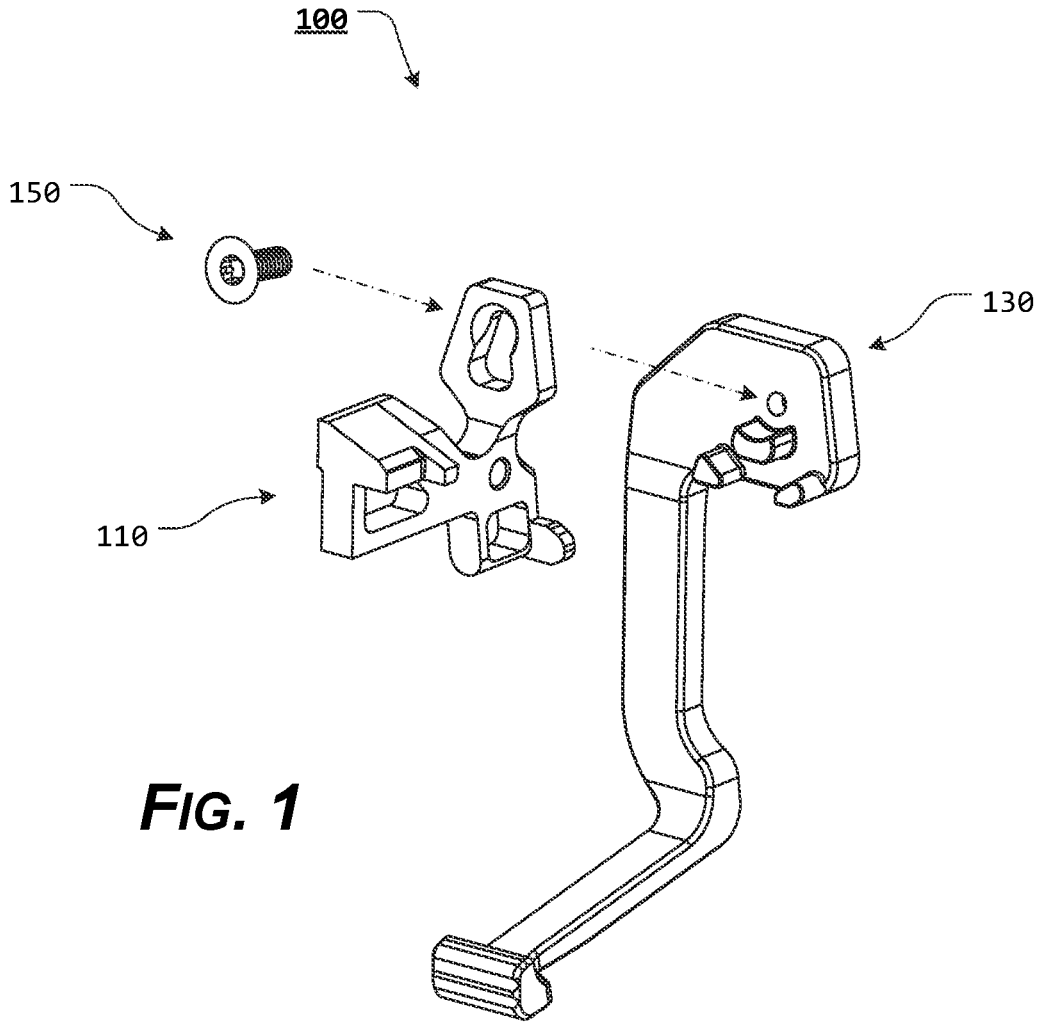
FIG. 1 illustrates an exploded, rear perspective view of an exemplary embodiment of an interchangeable element attachment system according to the present disclosure.
Figure 2:
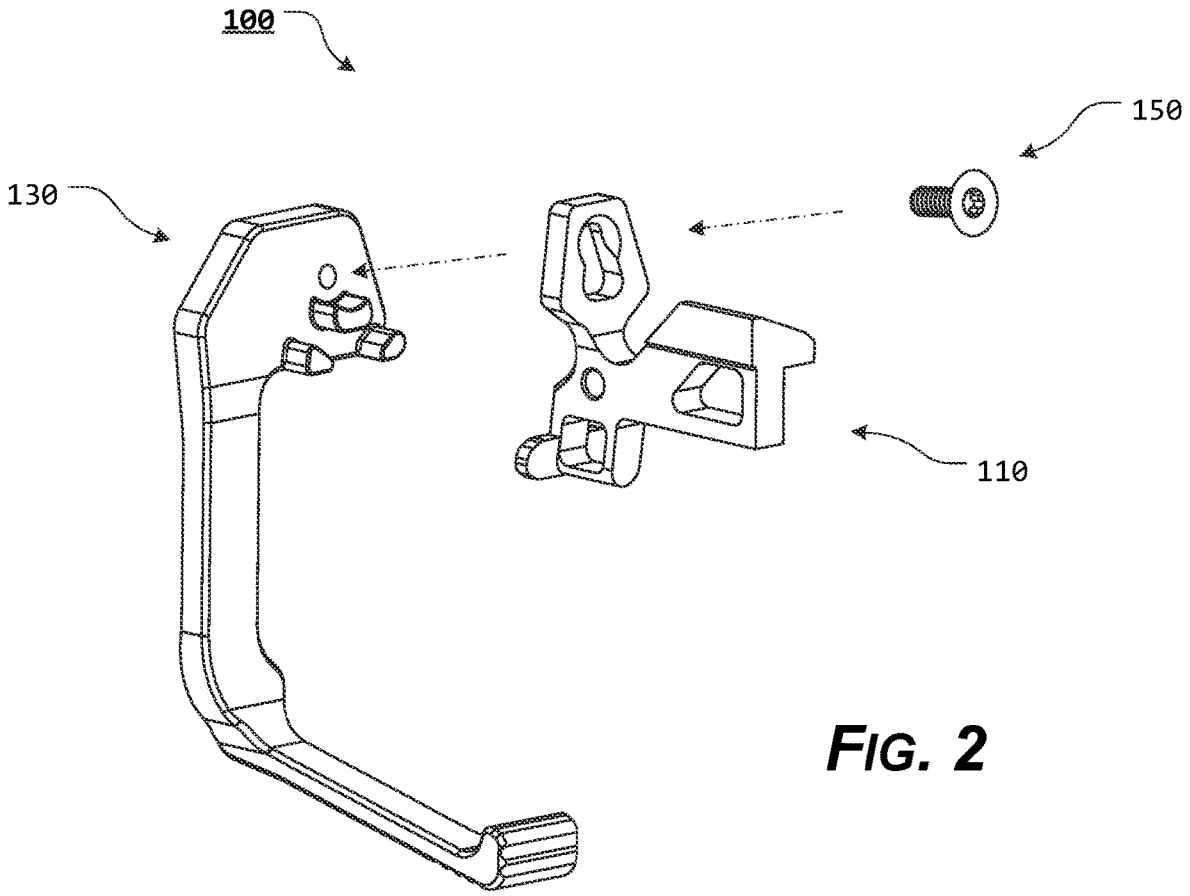
FIG. 2 illustrates an exploded, rear perspective view of an exemplary embodiment of an interchangeable element attachment system according to the present disclosure.
Figure 3:
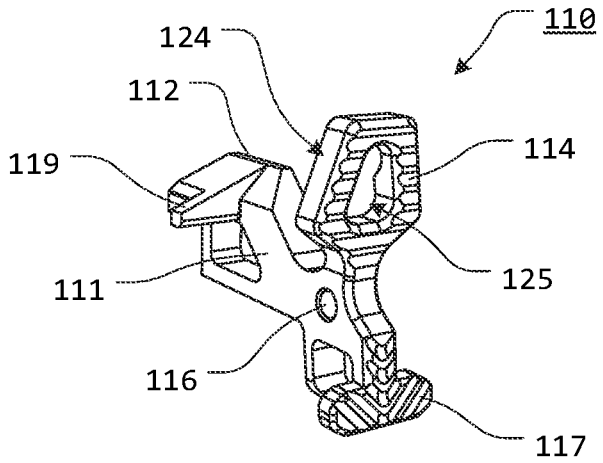
FIG. 3 illustrates a front, perspective view of an exemplary embodiment of a bolt catch according to the present disclosure.
Figure 4:
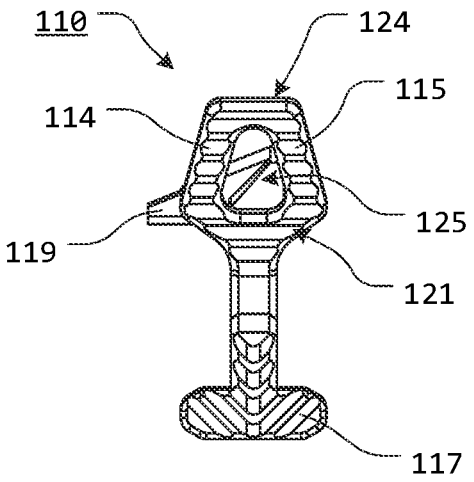
FIG. 4 illustrates a front view of an exemplary embodiment of a bolt catch according to the present disclosure.
Figure 5:
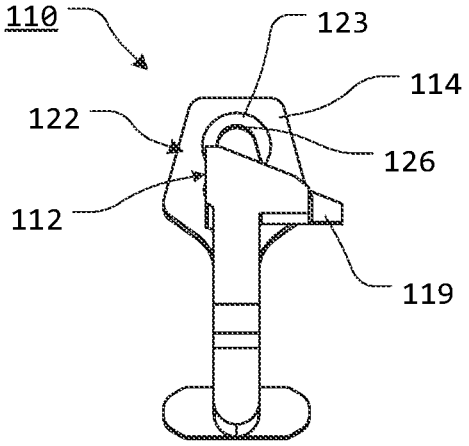
FIG. 5 illustrates a rear view of an exemplary embodiment of a bolt catch according to the present disclosure.
Figure 6:
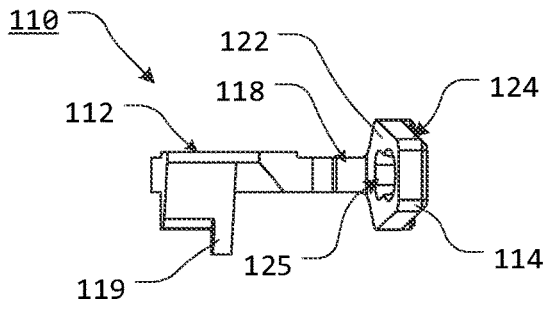
FIG. 6 illustrates a top view of an exemplary embodiment of a bolt catch according to the present disclosure.
Figure 7:
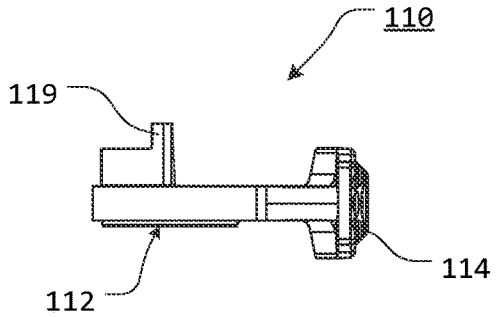
FIG. 7 illustrates a bottom view of an exemplary embodiment of a bolt catch according to the present disclosure.
Figure 8:
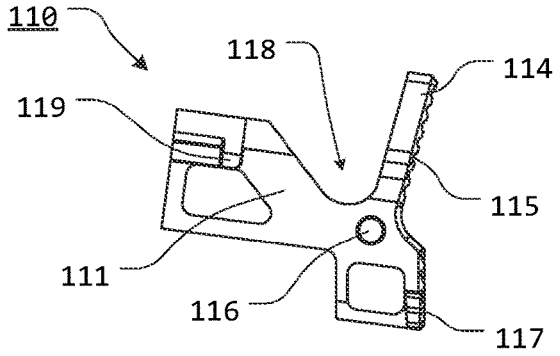
FIG. 8 illustrates a left side view of an exemplary embodiment of a bolt catch according to the present disclosure.
Figure 9:
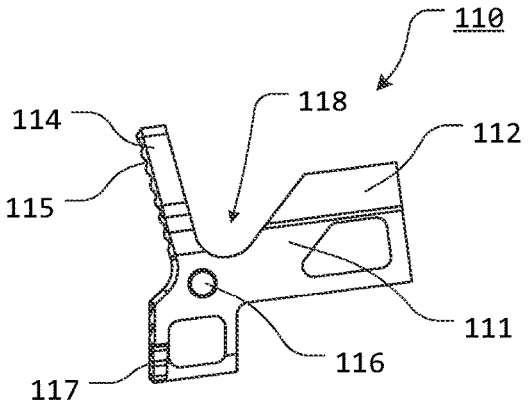
FIG. 9 illustrates a right side view of an exemplary embodiment of a bolt catch according to the present disclosure.
Figure 10:
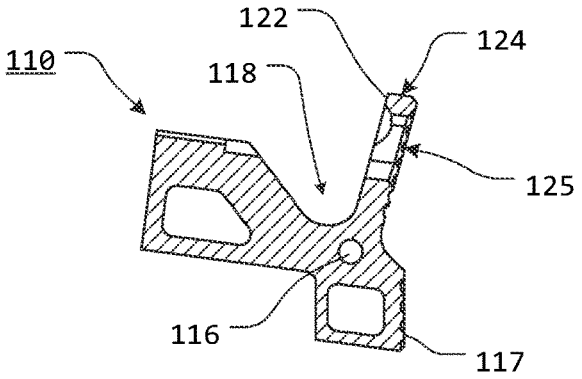
FIG. 10 illustrates a left side cross-sectional view of an exemplary embodiment of a bolt catch according to the present disclosure.
Figure 11:
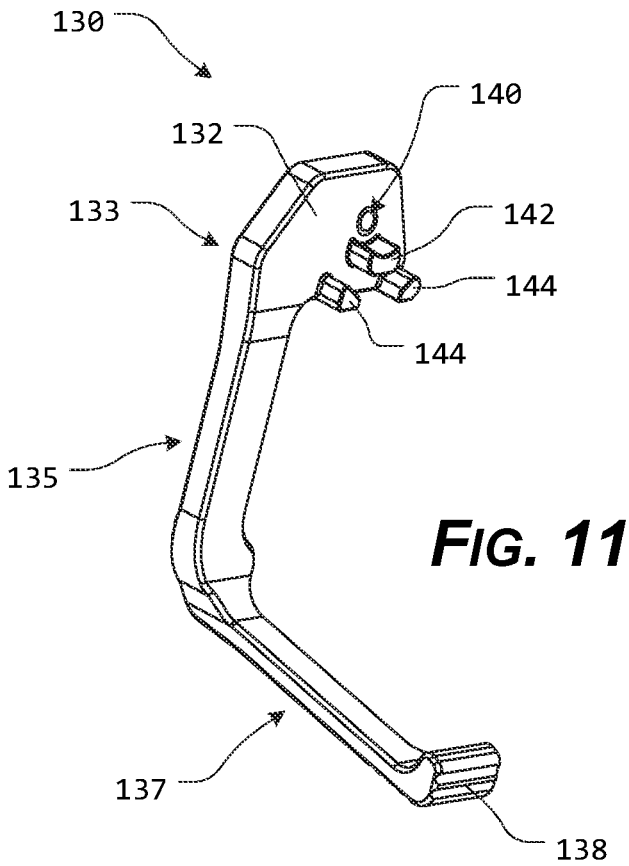
FIG. 11 illustrates a rear, upper perspective view of an assist lever according to an exemplary embodiment of the present disclosure.
Figure 12:
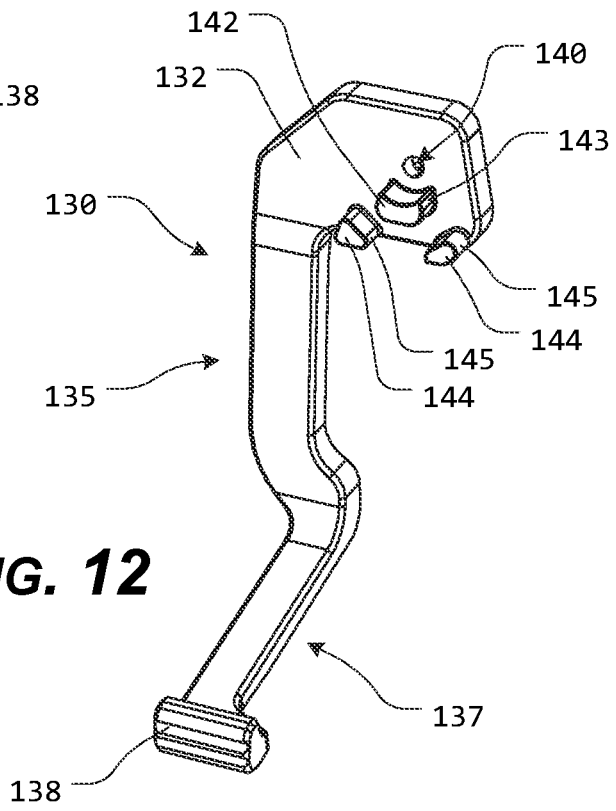
FIG. 12 illustrates a rear, upper perspective view of an assist lever according to an exemplary embodiment of the present disclosure.
Figure 13:
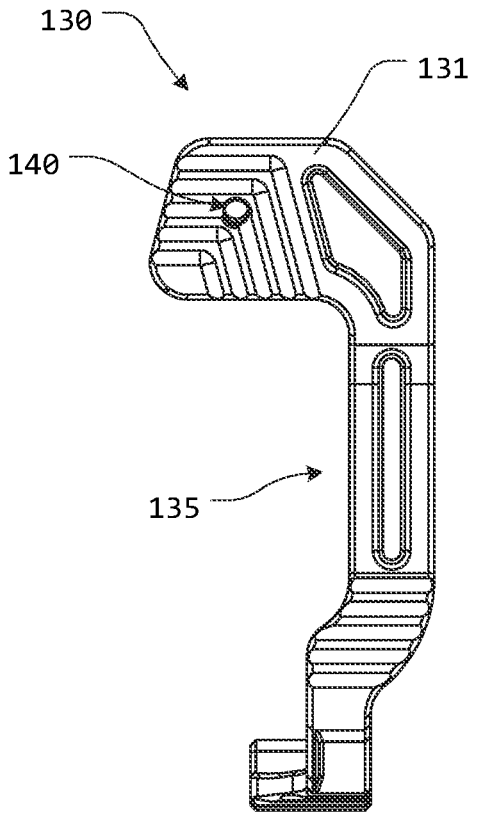
FIG. 13 illustrates a front view of an assist lever according to an exemplary embodiment of the present disclosure.
Figure 14:
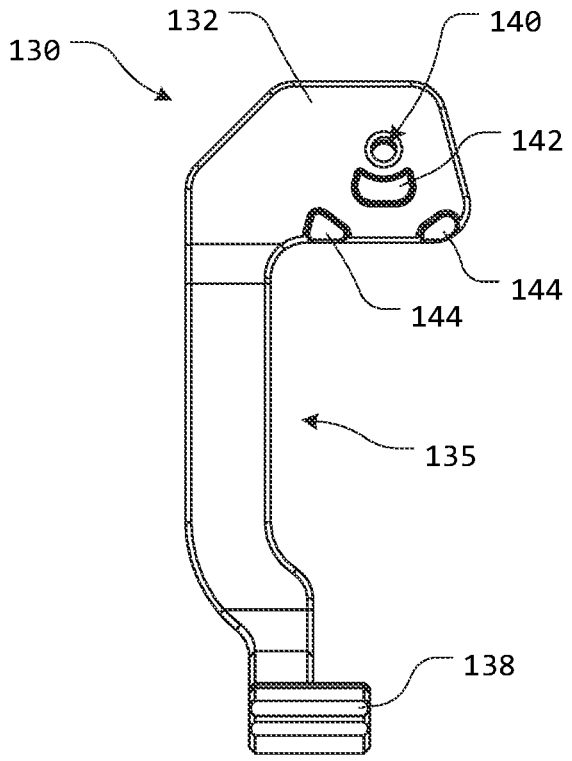
FIG. 14 illustrates a rear view of an assist lever according to an exemplary embodiment of the present disclosure.
Figure 15:
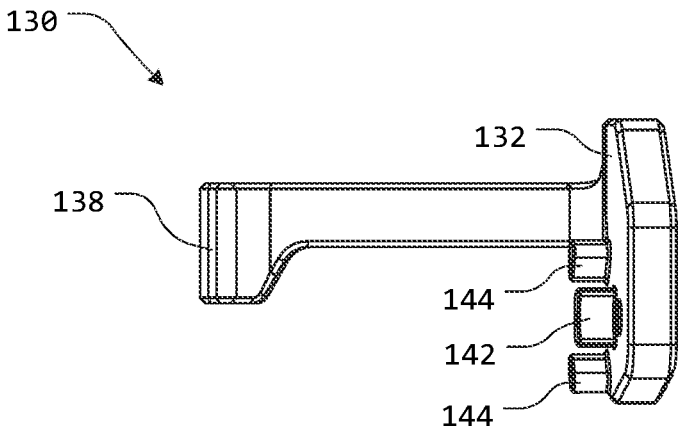
FIG. 15 illustrates a top view of an assist lever according to an exemplary embodiment of the present disclosure.
Figure 16:
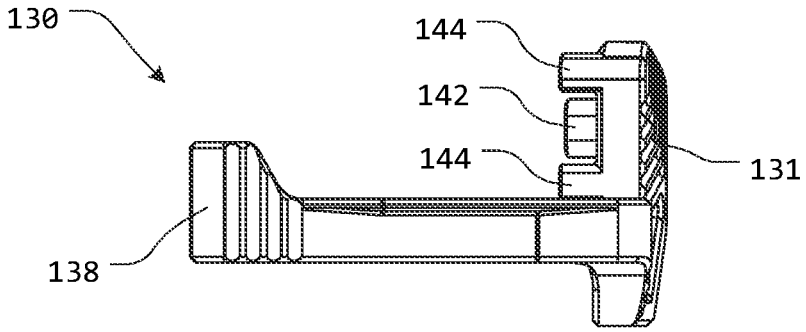
FIG. 16 illustrates a bottom view of an assist lever according to an exemplary embodiment of the present disclosure.
Figure 17:
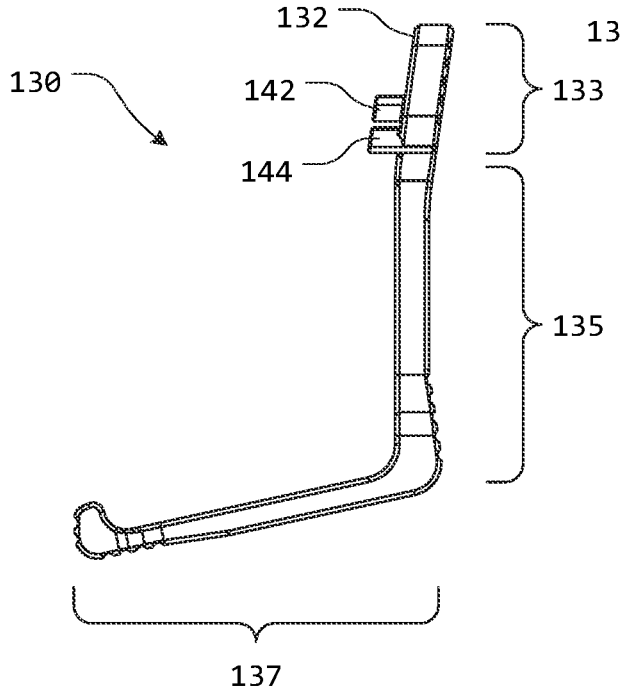
FIG. 17 illustrates a left side view of an assist lever according to an exemplary embodiment of the present disclosure.
Figure 18:
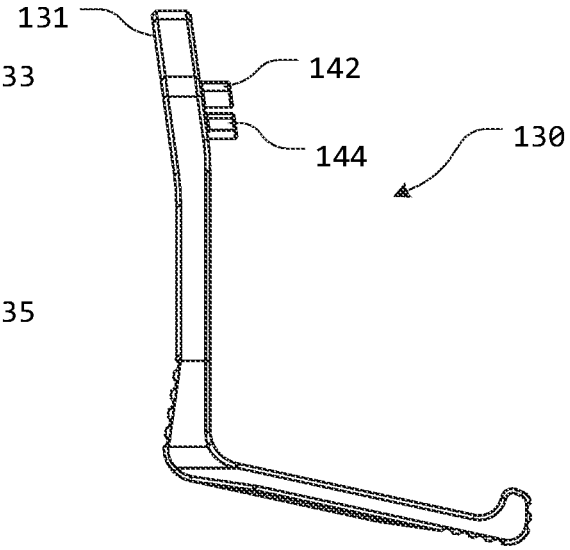
FIG. 18 illustrates a right side view of an assist lever according to an exemplary embodiment of the present disclosure.
Figure 19:
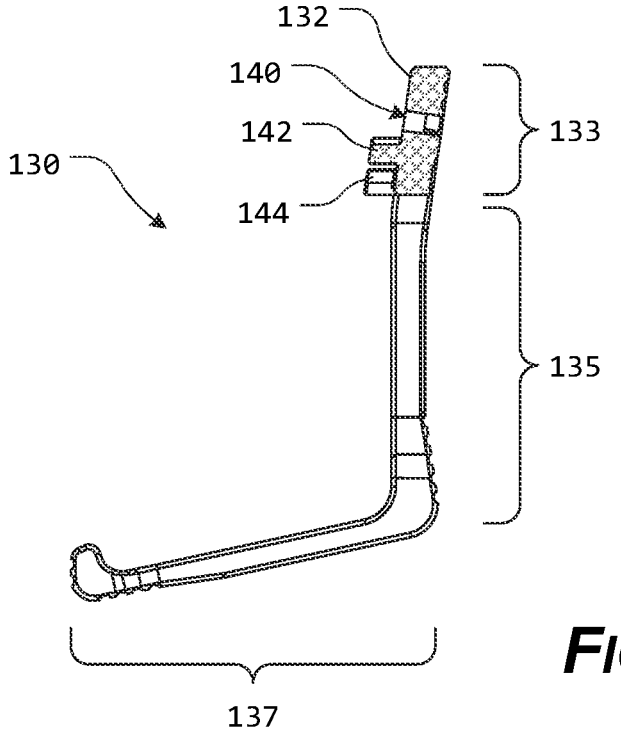
FIG. 19 illustrates a left side, cross-sectional view of an assist lever according to an exemplary embodiment of the present disclosure.
Figure 20:
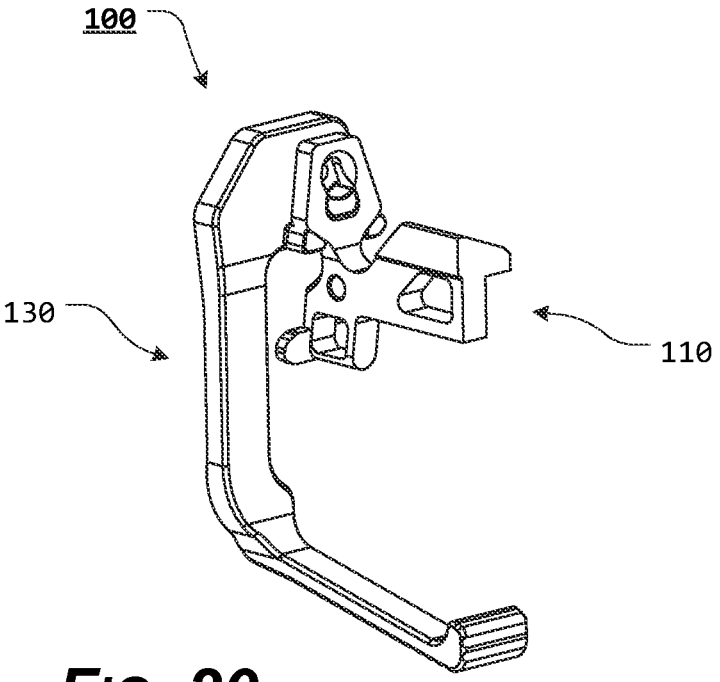
FIG. 20 illustrates a rear, perspective view of certain exemplary components of an exemplary embodiment of an interchangeable element attachment system according to the present disclosure.
Figure 21:
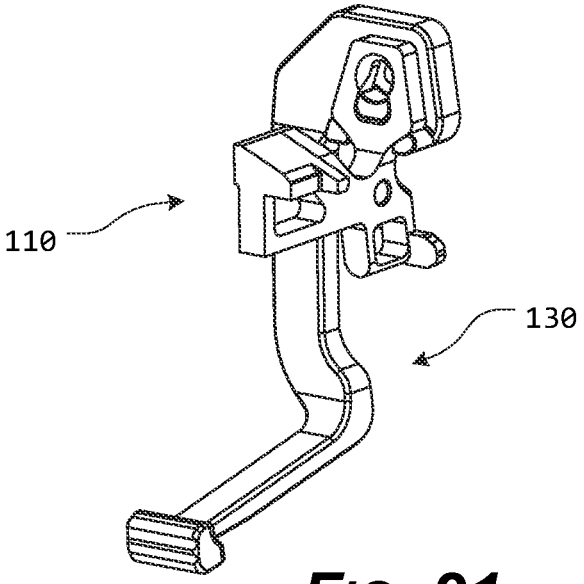
FIG. 21 illustrates a rear, perspective view of certain exemplary components of an exemplary embodiment of an interchangeable element attachment system according to the present disclosure.
Figure 22:
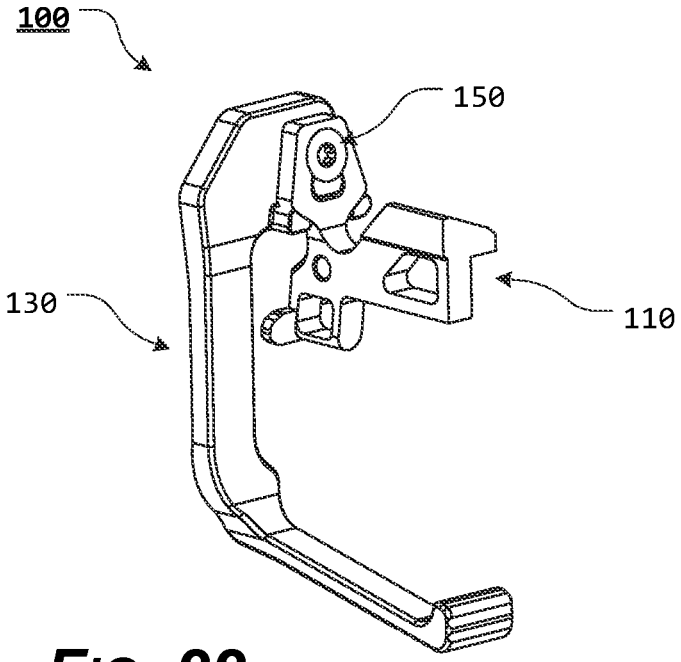
FIG. 22 illustrates a rear, perspective view of certain exemplary assembled components of an exemplary embodiment of an interchangeable element attachment system according to the present disclosure.
Figure 23:
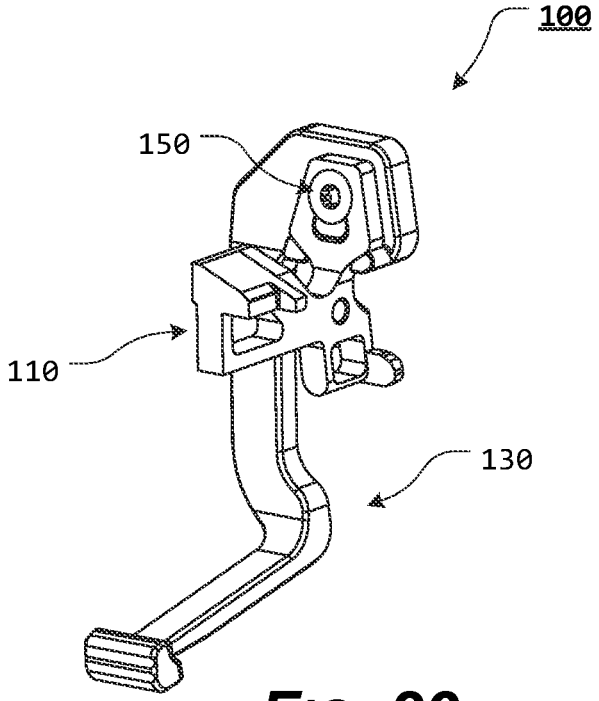
FIG. 23 illustrates a rear, perspective view of certain exemplary assembled components of an exemplary embodiment of an interchangeable element attachment system according to the present disclosure.
Figure 24:
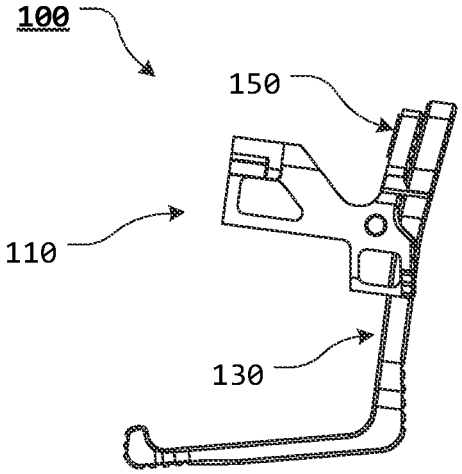
FIG. 24 illustrates a left side view of certain exemplary assembled components of an exemplary embodiment of an interchangeable element attachment system according to the present disclosure.
Figure 25:
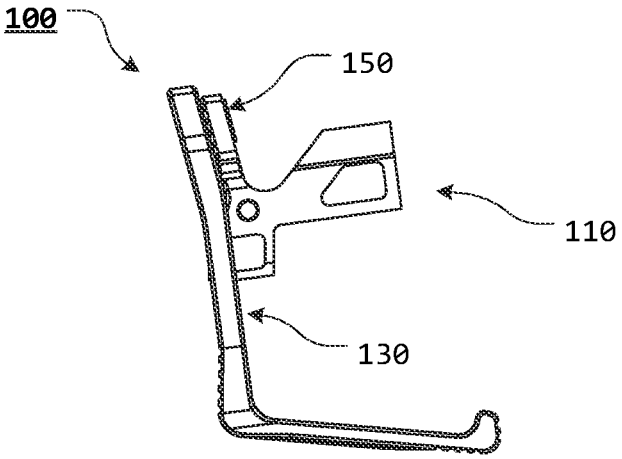
FIG. 25 illustrates a right side view of certain exemplary assembled components of an exemplary embodiment of an interchangeable element attachment system according to the present disclosure.
Figure 26:
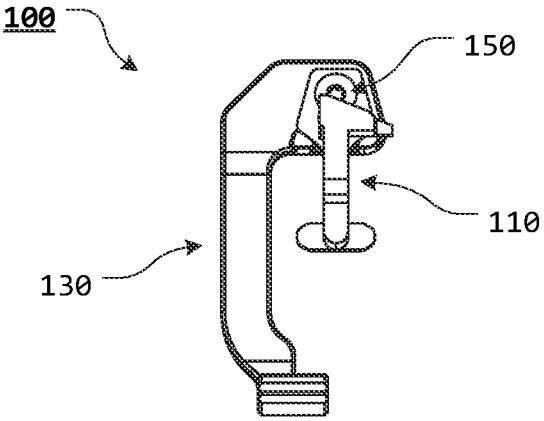
FIG. 26 illustrates a rear view of certain exemplary assembled components of an exemplary embodiment of an interchangeable element attachment system according to the present disclosure.
Figure 27:
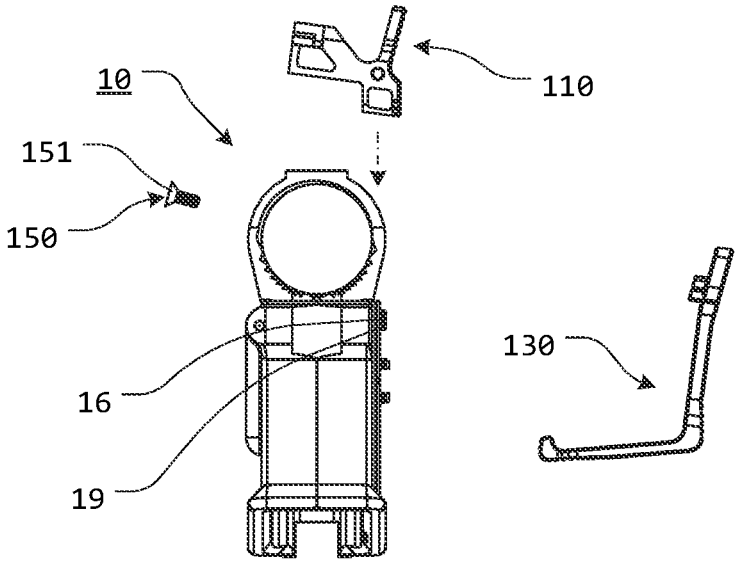
FIG. 27 illustrates a left side view of partially assembled components of an exemplary embodiment of an interchangeable element attachment system and an exemplary lower receiver according to the present disclosure.
Figure 28:
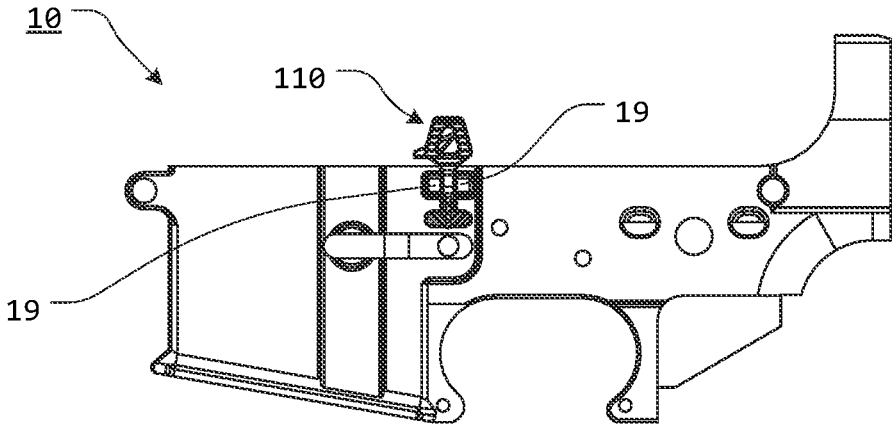
FIG. 28 illustrates a front view of an exemplary bolt catch attached or coupled to an exemplary lower receiver according to the present disclosure.
Figure 29:
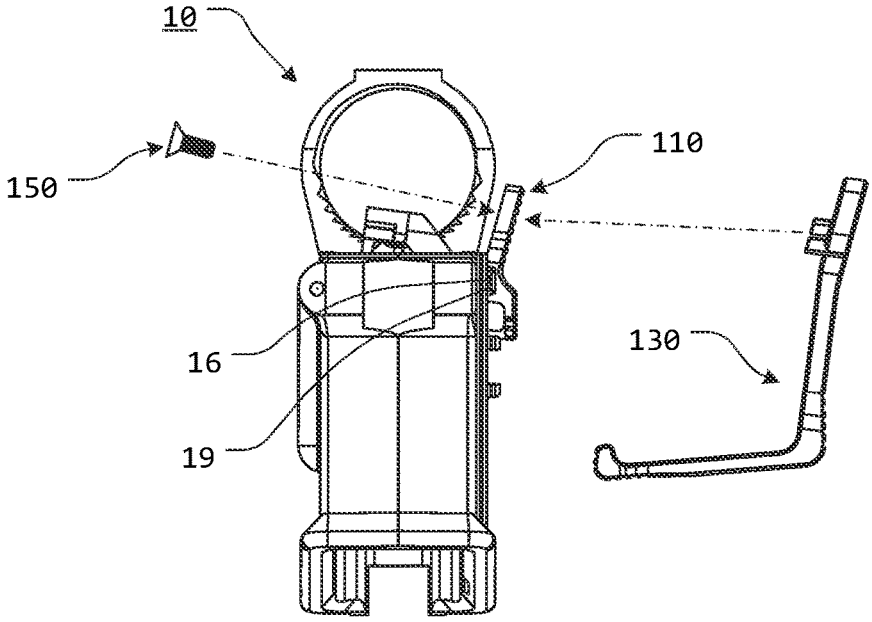
FIG. 29 illustrates a left side view of partially assembled components of an exemplary embodiment of an interchangeable element attachment system and an exemplary lower receiver according to the present disclosure.
Figure 30:
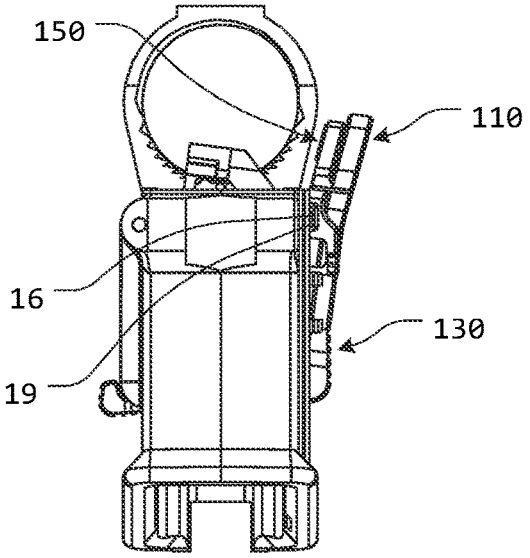
FIG. 30 illustrates a left side view of assembled components of an exemplary embodiment of an interchangeable element attachment system attached or coupled to an exemplary lower receiver according to the present disclosure.
Figure 31:
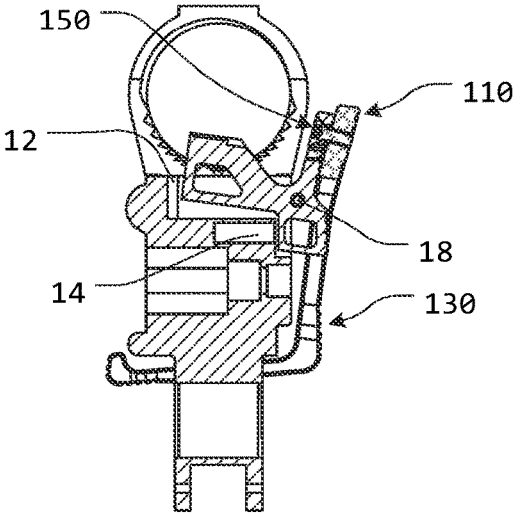
FIG. 31 illustrates a left side, cross-sectional view of assembled components of an exemplary embodiment of an interchangeable element attachment system attached or coupled to an exemplary lower receiver according to the present disclosure.
Figure 32:
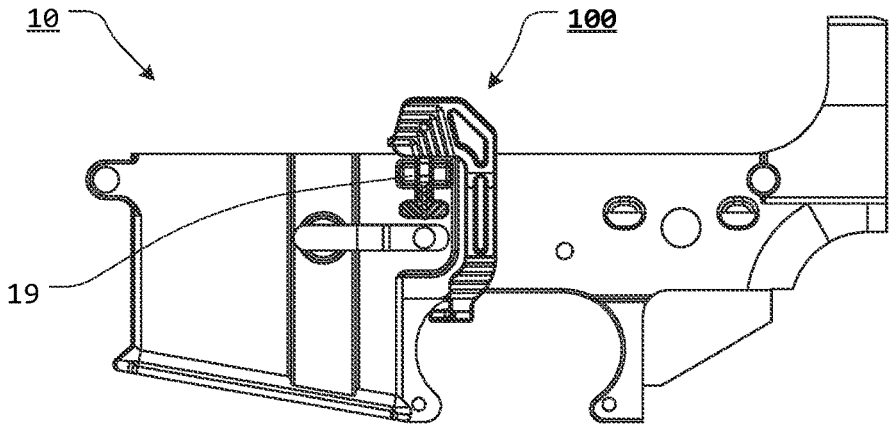
FIG. 32 illustrates a front view of assembled components of an exemplary embodiment of an interchangeable element attachment system attached or coupled to an exemplary lower receiver according to the present disclosure.
Figure 33:
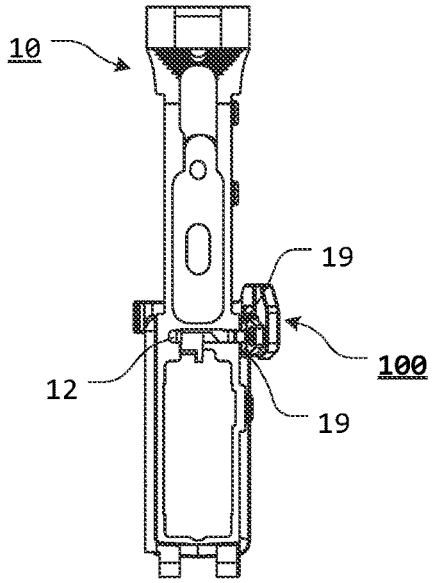
FIG. 33 illustrates a top view of assembled components of an exemplary embodiment of an interchangeable element attachment system attached or coupled to an exemplary lower receiver according to the present disclosure.
Figure 34:
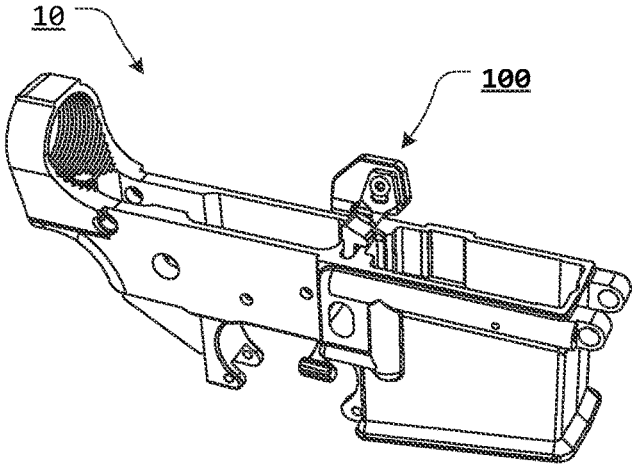
FIG. 34 illustrates an upper, rear, perspective, cross-sectional view of assembled components of an exemplary embodiment of an interchangeable element attachment system attached or coupled to an exemplary lower receiver according to the present disclosure.
Figure 35:
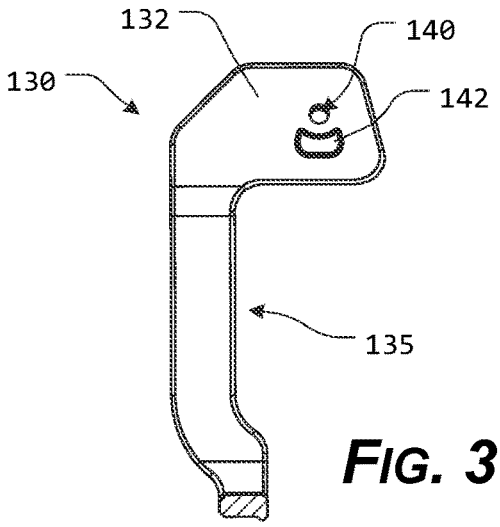
FIG. 35 illustrates a rear, cross-sectional view of an exemplary embodiment of an assist lever according to an exemplary embodiment of the present disclosure.
Figure 36:
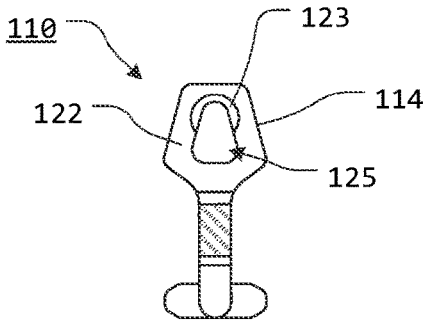
FIG. 36 illustrates a rear, cross-sectional view of an exemplary embodiment of a bolt catch according to an exemplary embodiment of the present disclosure.
Figure 37:
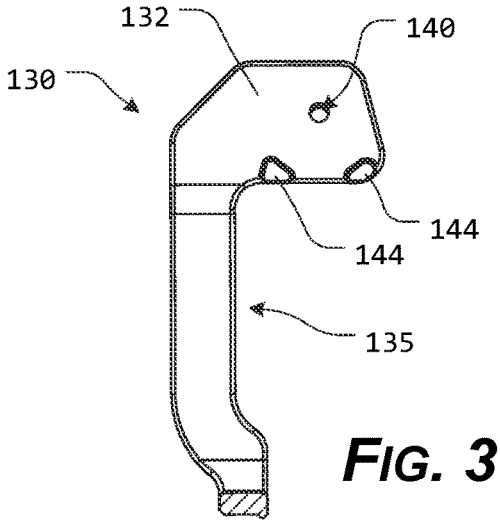
FIG. 37 illustrates a rear, cross-sectional view of an exemplary embodiment of an assist lever according to an exemplary embodiment of the present disclosure.
Figure 38:
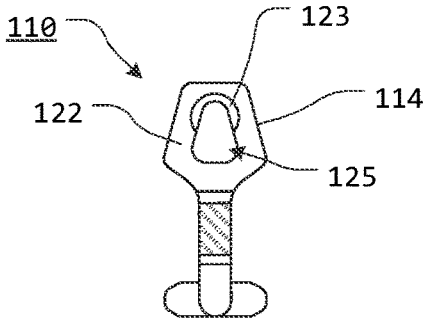
FIG. 38 illustrates a rear, cross-sectional view of an exemplary embodiment of a bolt catch according to an exemplary embodiment of the present disclosure.

The foregoing and other objectives, features, and advantages of the invention will be more readily understood upon consideration of the following description of the invention taken in conjunction with the accompanying drawings.

For simplicity and clarification, the design factors and operating principles of the interchangeable element attachment system according to the present disclosure are explained with reference to various exemplary embodiments of interchangeable element attachment system according to the present disclosure. The basic explanation of the design factors and operating principles of the interchangeable element attachment system is applicable for the understanding, design, and operation of the interchangeable element attachment system of the present disclosure. It should be appreciated that the interchangeable element attachment system can be adapted to many applications where a safety selector lever or an attachment system is necessary or desirable.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "fastener", "bolt catch", "assist lever", and "firearm" are used for basic explanation and understanding of the operation of the systems, methods, and apparatuses of the present disclosure. Therefore, the terms "fastener", "bolt catch", "assist lever", and "firearm" are not to be construed as limiting the systems, methods, and apparatuses of the present disclosure.

For simplicity and clarification, the interchangeable element attachment system of the present disclosure will be described as being used in connection with a bolt catch and an assist lever for an AR-15 or M4 style firearm. However, it should be appreciated that these are merely exemplary embodiments of the interchangeable element attachment system and are not to be construed as limiting the present disclosure. Thus, the interchangeable element attachment system of the present disclosure may be utilized in connection with any firearm or other device and may be utilized to attach or couple elements together.

In the form of the present disclosure chosen for purposes of illustration, FIGS. 3-10 illustrate various views of an exemplary bolt catch 110 of the interchangeable element attachment system 100. FIGS. 11-19 illustrate various views of an exemplary assist lever 130 of the interchangeable element attachment system 100. FIGS. 1-2 and 20-34 illustrate various exploded, partially exploded, and/or assembled views of the exemplary components of the interchangeable element attachment system 100 alone or attached or coupled to an exemplary lower receiver 10 of an exemplary firearm. Additionally, FIGS. 35-42 illustrate various rear views of certain other exemplary embodiments of the bolt catch 110 and the assist lever 130 useable with the interchangeable element attachment system 100.

FIGS. 3-10 illustrate certain elements and/or aspects of an exemplary attachment base in the form of an exemplary bolt catch 110. Generally, the bolt catch 110 comprises at least some of a bolt catch body portion 111, an upper button portion 114, a lower button portion 117, a bolt engagement projection 112, a magazine biasing projection 119, and a pivot pin aperture 116.

The upper button portion 114 is defined by an outer perimeter surface 124 and includes an upper button portion upper button portion first side 121 facing generally outward, away from the bolt engagement projection 112 and the magazine biasing projection 119, and an upper button portion second side 122 facing toward the bolt engagement projection 112 and the magazine biasing projection 119. The bolt catch body portion 111 comprises at least some of an upper button portion 114 and a lower button portion 117.

In various exemplary embodiments, the upper button portion first side 121 of the upper button portion 114 includes a textured portion. In various exemplary embodiments, the upper button portion first side 121 of the lower button portion 117 includes a textured portion (not shown). In this manner, the upper button portion 114 and/or the lower button portion 117 may be distinguished tactilely from other portions of the bolt catch 110.

In various exemplary, non-limiting embodiments, bolt catch 110 is pivotally connected to the lower receiver 10, between the upper button portion 114 and the lower button portion 117, via a fulcrum or bolt catch pivot pin 18 positioned through the lower receiver pivot pin apertures 16 and the pivot pin aperture 116. The lower receiver pivot pin apertures 16 are formed through the retaining lugs 19 of the lower receiver 10.

Generally, a portion of the bolt catch 110 is positioned within the lower bolt catch recess 12 such that the bolt engagement projection 112 and the magazine biasing projection 119 of the bolt catch 110 are positioned above the lower bolt catch recess 12, within at least a portion of the lower receiver 10.

When installed in a lower bolt catch recess 12 of the lower receiver 10, as illustrated in FIGS. 28-34, the bolt catch 110 is pivotable, relative to the lower receiver 10, via the bolt catch pivot pin 18 positioned through the pivot pin aperture 116. The bolt catch 110 is pivotably attached or coupled to a left side of the lower receiver 10, opposite the magazine release button. The upper button portion 114 or the lower button portion 117 can be pressed to pivot the bolt catch 110 about a pivot pin aperture 116 to pivot the bolt catch 110 from a bolt engagement position to a bolt disengagement position.

The bolt catch 110 is typically spring biased to the bolt disengagement position, via a bolt catch plunger and a bolt catch plunger spring positioned within the bolt catch plunger recess 14.

In the bolt engagement position, the bolt catch 110 is pivoted such that at least a portion of a bolt engagement projection 112 extends in front of a portion of the face of the bolt carrier (when the bolt carrier is in a rearward position) and is able to engage a portion of the bolt face to maintain the bolt carrier in the rearward position. In the bolt disengagement position, the bolt catch 110 is pivoted such that the bolt engagement projection 112 will not engage the face of the bolt carrier and the bolt engagement projection 112 will not engage the bolt carrier.

The magazine biasing projection 119 extends from the bolt catch 110 so as to interact with a follower in a magazine. In this manner, when an empty magazine is in the firearm, the magazine follower interacts with the magazine biasing projection 119, to pivot the bolt catch 110 to a bolt engagement position.

When the upper button portion 114 is depressed, the bolt catch 110 pivots such that the bolt engagement projection 112 is urged downward, away from the face of the bolt carrier, allowing the bolt carrier to move forward. When the lower button portion 117 is depressed, the bolt catch 110 pivots such that the bolt engagement projection 112 is urged upward, towards the face of the bolt carrier, prohibiting the bolt carrier to move forward and maintaining the bolt carrier in a rearward position.

It should be appreciated that a more detailed explanation of the components of the lower receiver 10 and bolt catch 110, instructions regarding how to attach and use the various components of the lower receiver 10 and bolt catch 110, methods for installing the related components of the lower receiver 10 and bolt catch 110, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the systems, methods, and/or apparatuses as described.

The bolt catch 110 further includes at least one attachment aperture 125 formed through a portion of the upper button portion 114. The attachment aperture 125 is formed through the bolt catch 110 from the upper button portion first side 121 through the upper button portion second side 122. The attachment aperture 125 is generally defined by one or more contiguous attachment aperture sidewalls 126.

In various exemplary embodiments, the attachment aperture 125 is a substantially triangular shaped aperture. However, it should be appreciated that, in various exemplary embodiments, as illustrated, for example, in FIGS. 38 and 40 may be formed of another shape. For example, the attachment aperture 125 may generally be formed in the shape of a triangle, a square, a rectangle, a pentagon, a hexagon, a heptagon, an octagon, a nonagon, a decagon, a pentadecagon, an icosagon, a circle, an oval, or any other desired shape or configuration. Thus, it should be appreciated that the size and shape of each of the attachment aperture 125 is a design choice based upon the desired functionality and/or appearance of the bolt catch 110 and/or assist lever 130.

FIGS. 11-19 illustrate certain elements and/or aspects of an exemplary attachment element in the form of an exemplary assist lever 130. Generally, the assist lever 130 includes an assist lever first side 131 and an assist lever second side 132 and comprises at least some of an attachment portion 133, a connector portion 135, and an extension arm 137 extending to an assist lever button portion 138.

The attachment portion 133 is formed so as to be attached or coupled to a portion of the bolt catch 110. The connector portion 135 extends between the attachment portion 133 and the extension arm 137. Generally, the assist lever 130 is formed such that if the bolt catch 110 is attached or coupled to a lower receiver 10 and the assist lever 130 is attached or coupled to the bolt catch 110, at least a portion of the extension arm 137 extends through a trigger guard portion of the lower receiver 10 such that the assist lever button portion 138 is accessible from the right side of the lower receiver 10 (on the same side as the magazine release button). In this manner, manipulation of at least the assist lever button portion 138 pivots the bolt catch 110 between the bolt engagement position and the bolt disengagement position.

To facilitate the secure and stable attachment or coupling of the assist lever 130 to the bolt catch 110, one or more attachment aperture engaging projections 142 and/or one or more perimeter engaging projections 144 extend from a portion of the assist lever second side 132 of the assist lever 130, within a portion of the attachment portion 133.

Each attachment aperture engaging projection 142 is defined by one or more attachment aperture engaging projection sidewalls 143 that extend from the assist lever second side 132. Each perimeter engaging projection 144 is defined by one or more perimeter engaging projection sidewalls 145.

At least a portion of the attachment aperture engaging projection 142 is defined by an exterior shape that matingly corresponds to a portion of the interior shape of the attachment aperture 125 of the bolt catch 110. In this manner, at least a portion of the attachment aperture engaging projection 142 may be received within at least a portion of the attachment aperture 125, such that one or more portions of the attachment aperture engaging projection sidewalls 143 may be abutted against one or more corresponding portions of the attachment aperture sidewalls 126.

At least a portion of each perimeter engaging projection 144 is defined by an exterior shape that matingly corresponds to a portion of the exterior shape of the outer perimeter surface 124 of the bolt catch 110. In this manner, at least a portion of each perimeter engaging projection 144 may abut and contact at least a portion of the outer perimeter surface 124, such that one or more portions of the perimeter engaging projection sidewalls 145 may be abutted against one or more corresponding portions of the outer perimeter surface 124.

In various exemplary embodiments, a portion of the attachment aperture engaging projection 142 is a substantially triangular shaped projection. However, it should be appreciated that, in various exemplary embodiments, as illustrated, for example, in FIGS. 37 and 39 each attachment aperture engaging projection 142 may be formed of another shape. For example, the attachment aperture engaging projection 142 may generally be formed in the shape of a triangle, a square, a rectangle, a pentagon, a hexagon, a heptagon, an octagon, a nonagon, a decagon, a pentadecagon, an icosagon, a circle, an oval, or any other desired shape or configuration. Additionally, a single attachment aperture engaging projection 142 may extend from the assist lever second side 132 or two or more attachment aperture engaging projections 142 may extend from the assist lever second side 132. Thus, it should be appreciated that the size, shape, and number of attachment aperture engaging projections 142 is a design choice based upon the desired functionality and/or appearance of the bolt catch 110 and/or assist lever 130.

In various exemplary embodiments, a portion of each perimeter engaging projection 144 is a substantially triangular shaped projection. However, it should be appreciated that, in various exemplary embodiments, as illustrated, for example, in FIGS. 37 and 39 each perimeter engaging projection 144 may be formed of another shape. For example, each perimeter engaging projection 144 may generally be formed in the shape of a triangle, a square, a rectangle, a pentagon, a hexagon, a heptagon, an octagon, a nonagon, a decagon, a pentadecagon, an icosagon, a circle, an oval, or any other desired shape or configuration. Additionally, a single perimeter engaging projection 144 may extend from the assist lever second side 132 or two or more perimeter engaging projections 144 may extend from the assist lever second side 132. Thus, it should be appreciated that the size, shape, and number of perimeter engaging projections 144 is a design choice based upon the desired functionality and/or appearance of the bolt catch 110 and/or assist lever 130.

The fastener recess 140 extends from the assist lever second side 132 of the assist lever 130, within the attachment portion 133. The fastener recess 140 is at least partially internally threaded. The internal threading of the fastener recess 140 is formed so as to allow interaction between the internal threads of the fastener recess 140 and external threads of a fastener 150, such that a fastener 150 can be repeatably threadedly attached or coupled to the assist lever 130. In various exemplary embodiments, the fastener recess 140 extends into a portion of the assist lever 130 without extending completely through the assist lever 130. Alternatively, the fastener recess 140 extends through the assist lever 130, from the assist lever second side 132 to the assist lever first side 131.

Each fastener 150 includes a head portion 151. In various exemplary embodiments, the fastener 150 is a flange tapered screw. It should be appreciated that other fasteners or screws may be utilized, but by utilizing a flange tapered screw fastener 150, at least a portion of the head portion 151 of the fastener 150 may be at least partially fitted within a tapered recess 123 formed within a portion of the upper button portion second side 122 of the bolt catch 110.

Additionally, if the head portion 151 of the fastener 150 is partially tapered, they head portion 151 assists in centering the bolt catch 110 relative to the fastener 150, via interaction between the tapered recess 123 and the head portion 151 of the fastener 150.

During attachment or coupling of the assist lever 130 to the bolt catch 110, as illustrated in FIGS. 1-2 and 20-34 (regardless of whether the bolt catch 110 is attached or coupled to a lower receiver 10), the assist lever is aligned with the bolt catch 110, such that each attachment aperture engaging projection 142 is aligned with the attachment aperture 125 and each perimeter engaging projection 144 (if included) is aligned with a mating portion of the outer perimeter surface 124. The upper button portion second side 122 of the attachment portion 133 of the assist lever 130 is urged toward the upper button portion first side 121 of the upper button portion 114 of the bolt catch 110 such that each attachment aperture engaging projection 142 is at least partially received within the attachment aperture 125 and one or more portions of the attachment aperture engaging projection sidewalls 143 are abutted against one or more corresponding portions of the attachment aperture sidewalls 126.

Additionally, each perimeter engaging projection 144 (if included) is aligned with a mating portion of the outer perimeter surface 124 such that one or more portions of the perimeter engaging projection sidewalls 145 are abutted against one or more corresponding portions of the outer perimeter surface 124.

Once the assist lever 130 is appropriately aligned with the bolt catch 110, the fastener recess 140 is appropriately centered relative to the attachment aperture 125. Thus, the fastener 150 is positioned through the aligned attachment aperture 125 and fastener recess 140. When the fastener 150 is rotated to or toward the upper button portion second side 122, the external threads of the fastener 150 interact with the internal threads of the attachment aperture 125 and the head portion 151 of the fastener 150 extends beyond one or more portions of the attachment aperture 125 and engages a portion of the upper button portion second side 122 and optionally a portion of the recess 123 to draw the assist lever 130 toward the bolt catch 110 until a portion of the assist lever second side 132 of the assist lever 130 is appropriately abutted against a portion of the upper button portion first side 121 of the bolt catch 110. When the fastener 150 is appropriately fastened and torqued the fastener 150, among other things, assists in maintaining an appropriately aligned positioned between the bolt catch 110 and the assist lever 130 and resists slidable movement of the assist lever 130 relative to the bolt catch 110.

Since both the attachment aperture 125 and the attachment aperture engaging projection 142 are formed to correspondingly tight tolerances, when the assist lever 130 is attached or coupled to the bolt catch 110, engagement between the attachment aperture engaging projection 142 and the attachment aperture 125 resists rotational movement of the assist lever 130 relative to the bolt catch 110. Since both the outer perimeter surface 124 and the perimeter engaging projections 144 are formed to correspondingly tight tolerances, when the assist lever 130 is attached or coupled to the bolt catch 110, engagement between the perimeter engaging projections 144 and the outer perimeter surface 124 resists rotational movement of the assist lever 130 relative to the bolt catch 110.

Thus, the interchangeable element attachment system 100 provides improved attachment or coupling between the assist lever 130 and the bolt catch 110.

In various exemplary embodiments, various components of the interchangeable element attachment system 100 are substantially rigid and are formed of stainless steel. Alternate materials of construction of the various components of the interchangeable element attachment system 100 may include one or more of the following: steel, aluminum, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the interchangeable element attachment system 100 is a design choice based on the desired appearance and functionality of the interchangeable element attachment system 100.

It should be appreciated that certain elements of the interchangeable element attachment system 100 may be formed as an integral unit (such as, for example, the attachment portion 133, the extension portion 135, and the extension arm 137). Alternatively, suitable materials can be used and sections or elements made independently and attached or coupled together, such as by adhesives, welding, screws, rivets, pins, or other fasteners, to form the various elements of the interchangeable element attachment system 100.

It should also be understood that the overall size and shape of the interchangeable element attachment system 100 and the various portions thereof, the bolt catch 110, and the assist lever 130, is a design choice based upon the desired functionality and/or appearance of the interchangeable element attachment system 100.

It should also be appreciated that a more detailed explanation of the specific dimensions of certain components of the interchangeable element attachment system 100, instructions regarding how to install the interchangeable element attachment system 100, methods for using the interchangeable element attachment system 100, once installed, and certain other items and/or techniques necessary for the implementation and/or operation of the various exemplary embodiments of the present disclosure are not provided herein because such background information will be known to one of ordinary skill in the art. Therefore, it is believed that the level of description provided herein is sufficient to enable one of ordinary skill in the art to understand and practice the systems, methods, and apparatuses of the presentation, as described.

FIGS. 35 and 36, 37 and 38, 39 and 40, and 41 and 42 show alternative embodiments of the assist lever 130 and bolt catch 110, respectively. As illustrated, for example, in FIG. 35, the assist lever 130 may optionally include a single attachment aperture engaging projection 142 and no perimeter engaging projections 144. Alternatively, as illustrated, for example, in FIG. 37, the assist lever 130 may optionally include perimeter engaging projections 144 and no attachment aperture engaging projection 142.

As further illustrated, overall shape of the one or more attachment aperture engaging projections 142 and the attachment aperture 125 may be altered but maintain a mating correspondence. Additionally, the overall shape of the one or more perimeter engaging projections 144 (if included) and the outer perimeter surface 124 may be altered but maintain a mating correspondence.

Figure 39:
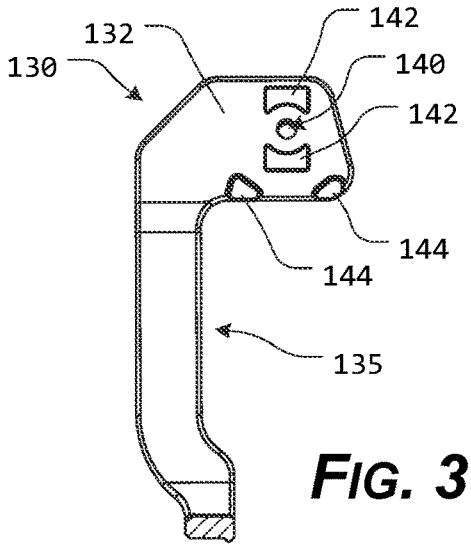
FIG. 39 illustrates a rear, cross-sectional view of an exemplary embodiment of an assist lever according to an exemplary embodiment of the present disclosure.
Figure 40:
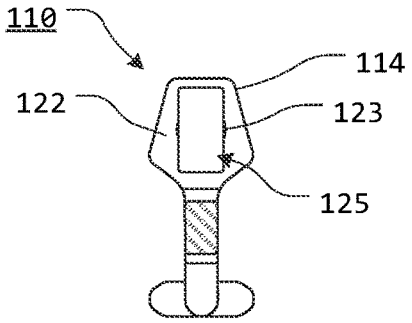
FIG. 40 illustrates a rear, cross-sectional view of an exemplary embodiment of a bolt catch according to an exemplary embodiment of the present disclosure.
Figure 41:
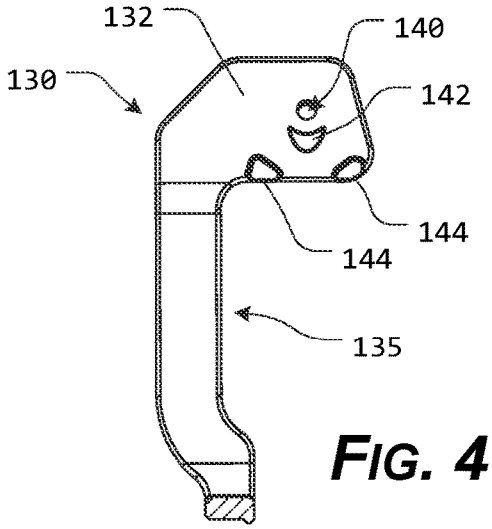
FIG. 41 illustrates a rear, cross-sectional view of an exemplary embodiment of an assist lever according to an exemplary embodiment of the present disclosure.
Figure 42:
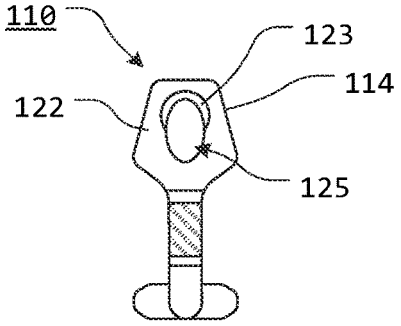
FIG. 42 illustrates a rear, cross-sectional view of an exemplary embodiment of a bolt catch according to an exemplary embodiment of the present disclosure.

As illustrated, for example, in FIG. 39, the assist lever 130 may optionally include a bifurcated or compound attachment aperture engaging projection 142. In these exemplary embodiments, two or more attachment aperture engaging projections 142 are included to more fully match the size and/or shape of a mating or corresponding attachment aperture 125.

Although the interchangeable element attachment system 100 is described as being used in connection with a bolt catch 110 and an assist lever 130, these are merely exemplary embodiments of the interchangeable element attachment system 100 and are not to be construed as limiting the present disclosure. Thus, the interchangeable element attachment system 100 of the present disclosure may be utilized in connection with any attachment base and attachment element. In these alternative embodiments, the attachment base includes certain features and/or elements of the bolt catch 110, such as, for example, an outer perimeter surface substantially similar to the outer perimeter surface 124 and an aperture substantially similar to the attachment aperture 125, while the attachment element includes certain features and/or elements of the assist lever 130, such as, for example, one or more aperture engaging projections substantially similar to the attachment aperture engaging projections 142, one or more perimeter engaging projections substantially similar to the one or more perimeter engaging projections 144, at least one fastener recess substantially similar to the fastener recess 140, and a fastener substantially similar to the fastener 150.

While the present disclosure has been described in conjunction with the exemplary embodiments outlined above, the foregoing description of exemplary embodiments of the present disclosure, as set forth above, are intended to be illustrative, not limiting and the fundamental disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An interchangeable element attachment system, comprising:

a bolt catch having an upper button portion defined by an outer perimeter surface and a lower button portion, wherein a pivot pin aperture is formed through said bolt catch between said upper button portion and said lower button portion, wherein at least one attachment aperture is formed through a portion of said upper button portion, and wherein said attachment aperture is defined by one or more attachment aperture sidewalls;

an assist lever having an attachment portion, a connector portion, and an extension arm extending to an assist lever button portion, wherein one or more attachment aperture engaging projections extend from a portion of an assist lever second side of said assist lever, within a portion of said attachment portion, wherein each attachment aperture engaging projection is defined by one or more attachment aperture engaging projection sidewalls, wherein one or more perimeter engaging projections extend from a portion of said assist lever second side of said assist lever, within a portion of said attachment portion, wherein each perimeter engaging projection is defined by one or more perimeter engaging projection sidewalls, wherein at least a portion of said attachment aperture engaging projection is received within at least a portion of said attachment aperture of said bolt catch, such that one or more portions of said attachment aperture engaging projection sidewalls are abutted against one or more corresponding portions of said attachment aperture sidewalls, wherein at least a portion of each perimeter engaging projection is abutted against at least a portion of said outer perimeter surface of said bolt catch, such that one or more portions of said perimeter engaging projection sidewalls may be abutted against one or more corresponding portions of said outer perimeter surface, and wherein at least one at least partially internally threaded fastener recess extends from said assist lever second side, within said attachment portion; and at least one fastener, wherein said at least one fastener is at least partially externally threaded, wherein said internal threading of said at least one fastener recess allows interaction between said internal threads of said at least one fastener recess and said external threads of said at least one fastener, and wherein if said assist lever is appropriately aligned with said bolt catch and said at least one fastener recess is appropriately centered relative to said attachment aperture, said at least one fastener is positionable through said aligned attachment aperture and fastener recess to engage a portion of an upper button portion second side to assist in attaching or coupling said assist lever to said bolt catch.

2. The interchangeable element attachment system of claim 1, wherein a portion of said upper button portion includes a textured portion.

3. The interchangeable element attachment system of claim 1, wherein said bolt catch is pivotally connected to a lower receiver via a bolt catch pivot pin positioned through a portion of said lower receiver and said pivot pin aperture.

4. The interchangeable element attachment system of claim 1, wherein said attachment aperture is defined by one or more contiguous attachment aperture sidewalls.

5. The interchangeable element attachment system of claim 1, wherein said attachment aperture is formed through said bolt catch from an upper button portion first side through an upper button portion second side.

6. The interchangeable element attachment system of claim 1, wherein said attachment aperture is a substantially triangular shaped aperture and a portion of said attachment aperture engaging projection is a substantially triangular shaped projection.

7. The interchangeable element attachment system of claim 1, wherein said connector portion extends between said attachment portion and said extension arm.

8. The interchangeable element attachment system of claim 1, wherein said assist lever is formed such that if said bolt catch is attached or coupled to a lower receiver and said assist lever is attached or coupled to said bolt catch, at least a portion of said extension arm extends through a trigger guard portion of said lower receiver.

9. The interchangeable element attachment system of claim 1, wherein at least a portion of said attachment aperture engaging projection is defined by an exterior shape that matingly corresponds to a portion of an interior shape of said attachment aperture of said bolt catch.

10. The interchangeable element attachment system of claim 1, wherein at least a portion of each perimeter engaging projection is defined by an exterior shape that matingly corresponds to a portion of said exterior shape of said outer perimeter surface of said bolt catch.

11. An interchangeable element attachment system, comprising:

a bolt catch having an upper button portion defined by an outer perimeter surface, wherein a pivot pin aperture is formed through said bolt catch, wherein at least one attachment aperture is formed through a portion of said upper button portion, and wherein said attachment aperture is defined by one or more attachment aperture sidewalls;

an assist lever having an attachment portion, wherein one or more perimeter engaging projections extend from a portion of said assist lever second side of said assist lever, within a portion of said attachment portion, wherein each perimeter engaging projection is defined by one or more perimeter engaging projection sidewalls, wherein at least a portion of each perimeter engaging projection is abutted against at least a portion of said outer perimeter surface of said bolt catch, such that one or more portions of said perimeter engaging projection sidewalls may be abutted against one or more corresponding portions of said outer perimeter surface, and wherein at least one at least partially internally threaded fastener recess extends from said assist lever second side, within said attachment portion; and at least one fastener, wherein said at least one fastener is at least partially externally threaded, wherein said internal threading of said at least one fastener recess allows interaction between said internal threads of said at least one fastener recess and said external threads of said at least one fastener, and wherein if said assist lever is appropriately aligned with said bolt catch and said at least one fastener recess is appropriately centered relative to said attachment aperture, said at least one fastener is positionable through said aligned attachment aperture and fastener recess to engage a portion of an upper button portion second side to assist in attaching or coupling said assist lever to said bolt catch.

12. An interchangeable element attachment system, comprising:

a bolt catch having an upper button portion defined by an outer perimeter surface, wherein at least one attachment aperture is formed through a portion of said upper button portion, and wherein said attachment aperture is defined by one or more attachment aperture sidewalls;

an assist lever having an attachment portion, wherein one or more attachment aperture engaging projections extend from a portion of an assist lever second side of said assist lever, within a portion of said attachment portion, wherein each attachment aperture engaging projection is defined by one or more attachment aperture engaging projection sidewalls, wherein at least a portion of said attachment aperture engaging projection is received within at least a portion of said attachment aperture of said bolt catch, such that one or more portions of said attachment aperture engaging projection sidewalls are abutted against one or more corresponding portions of said attachment aperture sidewalls, and wherein at least one at least partially internally threaded fastener recess extends from said assist lever second side, within said attachment portion; and at least one fastener, wherein if said assist lever is appropriately aligned with said bolt catch and said at least one fastener recess is appropriately centered relative to said attachment aperture, said at least one fastener is positionable through said aligned attachment aperture and fastener recess to threadedly engage a portion of an upper button portion second side to assist in attaching or coupling said assist lever to said bolt catch.

13. The interchangeable element attachment system of claim 12, wherein one or more perimeter engaging projections extend from a portion of said assist lever second side of said assist lever, within a portion of said attachment portion, and wherein each perimeter engaging projection is defined by one or more perimeter engaging projection sidewalls.

14. The interchangeable element attachment system of claim 12, wherein at least a portion of each perimeter engaging projection is abutted against at least a portion of said outer perimeter surface of said bolt catch, such that one or more portions of said perimeter engaging projection sidewalls may be abutted against one or more corresponding portions of said outer perimeter surface.

15. The interchangeable element attachment system of claim 12, wherein said assist lever is formed such that if said bolt catch is attached or coupled to a lower receiver and said assist lever is attached or coupled to said bolt catch, at least a portion of said assist lever extends through a trigger guard portion of said lower receiver.

16. The interchangeable element attachment system of claim 12, wherein at least a portion of said attachment aperture engaging projection is defined by an exterior shape that matingly corresponds to a portion of an interior shape of said attachment aperture of said bolt catch.

17. The interchangeable element attachment system of claim 12, wherein at least a portion of each perimeter engaging projection is defined by an exterior shape that matingly corresponds to a portion of said exterior shape of said outer perimeter surface of said bolt catch.

* * * * *